US010328700B2

(12) United States Patent
Kinoshita

(10) Patent No.: US 10,328,700 B2
(45) Date of Patent: Jun. 25, 2019

(54) LIQUID EJECTING HEAD, LIQUID EJECTING APPARATUS, AND PRODUCTION METHOD FOR LIQUID EJECTING HEAD

(71) Applicant: SEIKO EPSON CORPORATION, Tokyo (JP)

(72) Inventor: Tomoo Kinoshita, Fujimi-cho (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/902,848

(22) Filed: Feb. 22, 2018

(65) Prior Publication Data

US 2018/0236770 A1 Aug. 23, 2018

(30) Foreign Application Priority Data

Feb. 23, 2017 (JP) ..... 2017-032041

(51) Int. Cl.
*B41J 2/16* (2006.01)
*B41J 2/14* (2006.01)

(52) U.S. Cl.
CPC ..... *B41J 2/1607* (2013.01); *B41J 2/14233* (2013.01); *B41J 2/14274* (2013.01); *B41J 2/161* (2013.01); *B41J 2/1623* (2013.01); *B41J 2002/14362* (2013.01); *B41J 2002/14419* (2013.01); *B41J 2002/14491* (2013.01)

(58) Field of Classification Search
CPC .. B41J 2/1607; B41J 2/14233; B41J 2/14274; B41J 2/161; B41J 2/1623
See application file for complete search history.

(56) References Cited

U.S. PATENT DOCUMENTS

2001/0030674 A1* 10/2001 Matsuzawa ..... B41J 2/14233 347/70
2002/0118254 A1* 8/2002 Wong ..... B41J 2/14024 347/50
2011/0242190 A1 10/2011 Suzuki et al.
2015/0253484 A1* 9/2015 Araki ..... G02B 6/0031 349/65

FOREIGN PATENT DOCUMENTS

JP 2011-207181 A 10/2011

* cited by examiner

*Primary Examiner* — Lamson D Nguyen
(74) *Attorney, Agent, or Firm* — Workman Nydegger

(57) ABSTRACT

A liquid ejecting head includes a head body, a first member that has a first surface and a second surface and that holds the head body, a second member that has a third surface and that is adhered to the first surface by a first adhesive so that the third surface is along planar directions of the second surface, and a third member that is disposed so as to extend over the second surface and the third surface and that is adhered to the second surface and the third surface by a second adhesive. At an intersection portion at which the first adhesive and the second adhesive contact, an adhesive receiving portion that accepts inflow of at least one of the first adhesive and the second adhesive is formed.

15 Claims, 11 Drawing Sheets

LIQUID EJECTING HEAD, LIQUID EJECTING APPARATUS, AND PRODUCTION METHOD FOR LIQUID EJECTING HEAD

BACKGROUND

1. Technical Field

The present invention relates to a liquid ejecting head that includes three members adhered by adhesive, a liquid ejecting apparatus, and a production method for the liquid ejecting head.

2. Related Art

A liquid ejecting apparatus includes a liquid ejecting head and is capable of ejecting various kinds of liquids from the ejecting head. Examples of the liquid ejecting apparatus include image recording apparatuses, such as ink jet type printers and ink jet type plotters. The liquid ejecting apparatus is capable of accurately landing very small amounts of liquid at predetermined locations and, because of this advantage, is recently applied to various production apparatuses as well. For example, the liquid ejecting apparatus is applied to display production apparatuses that produce color filters of liquid crystal displays and the like, electrode forming apparatuses that form electrodes of organic electroluminescence (EL) displays, field emission displays (FEDs), etc., and chip production apparatuses that produce biochips (biochemical devices). While a recording head for an image recording apparatus ejects liquid-state inks, a color material ejecting head for a display production apparatus ejects solutions of color materials of red (R), green (G), blue (B), etc. Furthermore, an electrode material ejecting head for an electrode forming apparatus ejects an electrode material in a liquid state, and a bioorganic material ejecting head for a chip production apparatus ejects a solution of a bioorganic material.

A liquid ejecting head as described above includes a first retainer member that holds a head body provided with nozzles, a second retainer member adhered to the first retainer member, and a circuit substrate disposed in a space between the first retainer member and the second retainer member (see, for example, JP-A-2011-207181). The aforementioned space has an opening in a side surface of the first retainer member and the second retainer member and is tightly sealed by a protective member closing the opening. That is, the foregoing space is tightly sealed by the first retainer member, the second retainer member, and the protective member.

In the foregoing related-art configuration, there is possibility that variations of adhesives may result in impeded adhesion of a protective member or insufficient sealing of the internal space. Concretely, for example, as illustrated in FIG. 16, in a configuration formed by adhering a first retainer member 91 and a second retainer member 92 by a first adhesive 93 and then bringing a protective member 94 near (as indicated by an arrow in FIG. 16) to the first retainer member 91 and the second retainer member 92 adhered to each other and adhering the protective member 94 thereto by a second adhesive 95, if the amount of the first adhesive 93 happens to be large due to discrepancy, there is possibility that the first adhesive 93 may squeeze out from the space between the first retainer member 91 and the second retainer member 92 and harden on the outer sides thereof. The protrusion of the first adhesive 93 may possibly inhibit the protective member 94 from being adhered to the first retainer member 91 and the second retainer member 92. In order to avoid this problem, it is conceivable to reduce the set amount of the first adhesive 93 applied so that the first adhesive 93 will not squeeze out despite such variations in the amount applied. However, this measure may possibly result in an excessively small amount of the first adhesive 93 applied due to variations such that, as illustrated in FIG. 17, the first adhesive 93 does not sufficiently fill the space between the first retainer member 91 and the second retainer member 92 but allows a gap (void) 96 to form between the first retainer member 91 and the second retainer member 92. If such a gap 96 form, the internal space defined by the first retainer member 91, the second retainer member 92, and the protective member 94 communicates with an external space via the gap 96. This may possibly allow undesired matter, such as ink or dust, to enter the internal space and stain and spoil a member disposed within the space, for example, a circuit substrate or the like.

SUMMARY

An advantage of some aspects of the invention is provision of a liquid ejecting head, a liquid ejecting apparatus, and a production method for the liquid ejecting head in which formation of a gap between members is inhibited.

A first aspect of the invention provides a liquid ejecting head that includes a head body provided with nozzles that eject a liquid, a first member that has a first surface and a second surface which intersects the first surface and that holds the head body at a location apart from the first surface and the second surface, a second member that has a third surface and that is adhered to the first surface of the first member by a first adhesive so that the third surface is along a planar direction of the second surface of the first member, a third member that is disposed so as to extend over the second surface and the third surface and that is adhered to the second surface and the third surface by a second adhesive, a space surrounded by the first member, the second member, the third member, the first adhesive, and the second adhesive, and an adhesive receiving portion that communicates with an intersection portion at which the first adhesive and the second adhesive contact and that accepts inflow of at least one of the first adhesive and the second adhesive.

According to this aspect of the invention, even when the amount of the first adhesive happens to be large at the time of adhering the first member and the second member, the first adhesive flows into the adhesive receiving portion, so that the first adhesive can be inhibited from squeezing out to the outsides of the first member and the second member. Therefore, the amount of the first adhesive can be increased so that the first adhesive more easily fills the joining portion between the first member and the second member. As a result, it is possible to inhibit formation of a gap between the first member and the second member.

In the foregoing liquid ejecting head according to the first aspect of the invention, the adhesive receiving portion may be at least partially defined by a chamfer that is formed on one of the first member and the second member and that extends from a first surface side toward a third member side.

According to this embodiment, the adhesive receiving portion can be easily formed.

In the foregoing liquid ejecting head, the adhesive receiving portion may be at least partially defined by a chamfer that is formed on the first member and that extends from a first surface side toward a third member side and a chamfer that is formed on the second member and that extends from the first surface side toward the third member side.

According to this embodiment, the adhesive receiving portion can be easily formed. Furthermore, because an increased amount of adhesive can be received by the adhesive receiving portion, it is possible to inhibit the first adhesive from squeezing out to the outsides of the first member and the second member even in the case where the amount of the first adhesive varies to a great extent. Therefore, the amount of the first adhesive can be further increased so that the first adhesive even more easily fills the joining portion between the first member and the second member. As a result, it is possible to further inhibit formation of a gap between the first member and the second member.

In the foregoing liquid ejecting head, the chamfer may have a curved surface.

According to this embodiment, the first adhesive or the second adhesive easily flows along the curved surface into the adhesive receiving portion. As a result, the adhesive receiving portion is more easily filled with either one or both of the first adhesive and the second adhesive, so that formation of a gap between the first member and the second member can be further inhibited.

Furthermore, in the foregoing liquid ejecting head, a dimension of the chamfer measured between a first surface-side end and a third member-side end on a space side of the chamfer may be different from a dimension of the chamfer measured between a first surface-side end and a third member-side end on an opposite side of the chamfer to the space.

This embodiment facilitates control of the squeezing-out of either one or both of the first adhesive and the second adhesive. That is, by making a size of the chamfer smaller (i.e., a dimension of the chamber measured between the first surface-side end and the third member-side end) on one of the space side of the chamfer and the opposite side of the chamfer to space on which it is desired to inhibit the squeezing-out of the adhesive, the squeezing-out of the adhesive to that side can be inhibited. As a result, for example, a defective condition in which the adhesive deposits on other component parts or the like can be inhibited and the reliability of the liquid ejecting head can be increased.

Furthermore, in the foregoing ejecting head, a first surface-side opening width of the adhesive receiving portion may be larger than a third member-side opening width of the adhesive receiving portion.

According to this embodiment, even in the case where the amount of the first adhesive used to adhere the first member and the second member tends to vary greatly, it can be made more certain that the first adhesive will reach the adhesive receiving portion. As a result, formation of a gap between the first member and the second member can be further inhibited.

Furthermore, in the foregoing liquid ejecting head, the second adhesive in a liquid state prior to hardening may have lower viscosity than the first adhesive in a liquid state prior to hardening.

According to this embodiment, at the time of adhering the third member, it is easier for the second adhesive to fill a portion between the first member and the second member which is not filled with the first adhesive. As a result, formation of a gap between the first member and the second member can be more certainly inhibited.

A second aspect of the invention provides a liquid ejecting apparatus that includes any one of the above-described liquid ejecting heads.

According to this aspect of the invention, the reliability of the liquid ejecting apparatus can be increased.

A third aspect of the invention provides a production method for a liquid ejecting head that includes a head body provided with nozzles that eject a liquid, a first member that has a first surface and a second surface which intersects the first surface and that holds the head body at a location apart from the first surface and the second surface, a second member that has a third surface and that is adhered to the first surface of the first member by a first adhesive so that the third surface is along a planar direction of the second surface of the first member, a third member that is disposed so as to extend over the second surface and the third surface and that is adhered to the second surface and the third surface by a second adhesive, a space surrounded by the first member, the second member, the third member, the first adhesive, and the second adhesive, and an adhesive receiving portion that communicates with an intersection portion at which the first adhesive and the second adhesive contact and that accepts inflow of at least one of the first adhesive and the second adhesive. The production method includes a first adhering step of adhering the first member and the second member by the first adhesive, and a second adhering step of adhering the first member and the second member to the third member by the second adhesive after the first adhering step.

According to this aspect of the invention, a liquid ejecting head in which formation of a gap between the first member and the second member is inhibited can be created.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will be described hereinafter with reference to the accompanying drawings. Although in the following exemplary embodiments, various limitations are described as preferred concrete examples of the invention, such examples of limitations do not actually limit the scope of the invention unless particular limitation of the invention is stated in the following description. The following description will be made in conjunction with an ink jet type printer (hereinafter, referred to simply as printer) 1 that is a kind of a liquid ejecting apparatus and an ink jet type recording head (hereinafter, referred to simply as recording head) 3 that is a kind of a liquid ejecting head mounted in the printer 1, which are mere examples.

Figure 1:
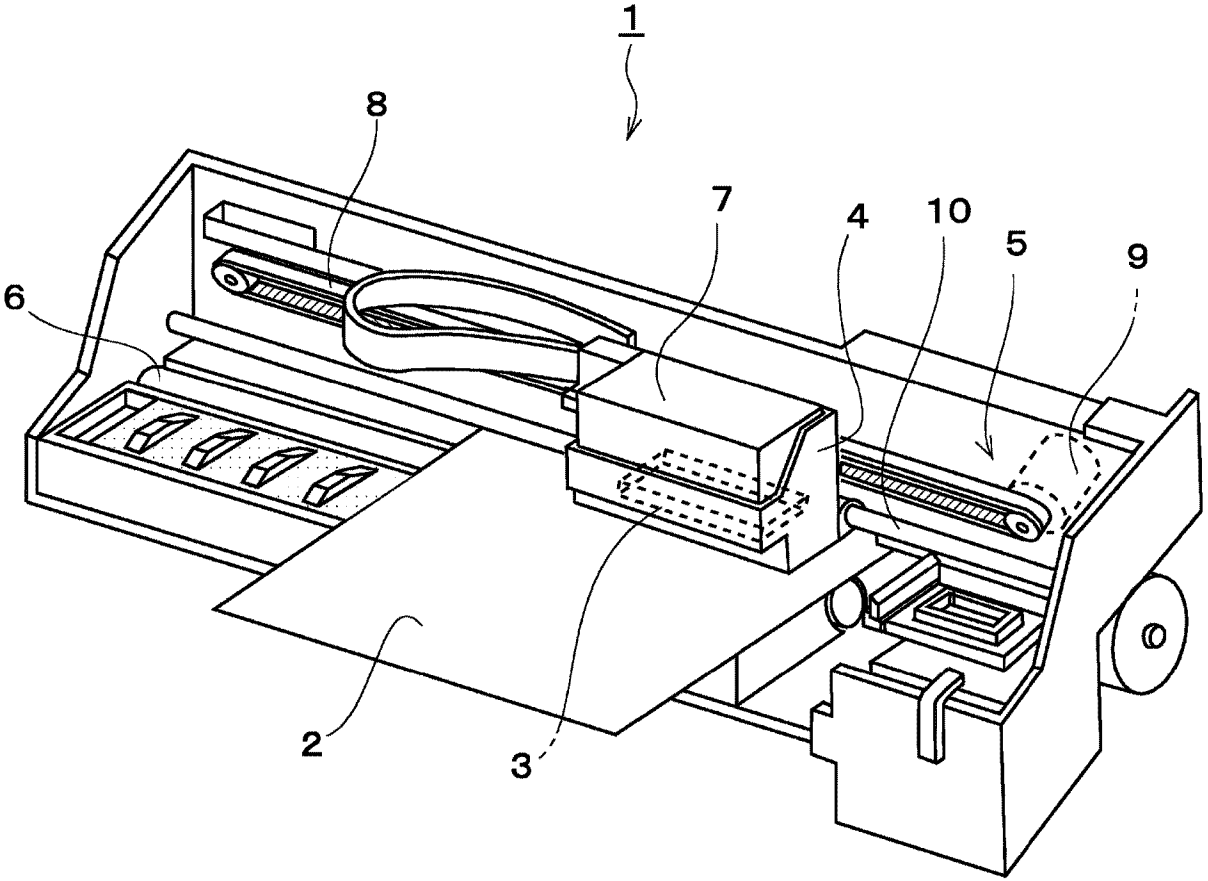
FIG. 1 is a perspective view illustrating an internal configuration of a printer.

FIG. 1 is a perspective view illustrating an internal configuration of the printer 1. The printer 1 is an apparatus that records an image or the like on a surface of a recording medium 2 (a kind of landing target), such as a recording sheet of paper, by ejecting an ink (a kind of liquid) to the surface of the recording medium 2. As illustrated in FIG. 1, the printer 1 includes a recording head 3, a carriage 4 to which the recording head 3 is attached, a carriage moving mechanism 5 that moves the carriage 4 in main scanning directions, a transporting mechanism 6 that moves the recording medium 2 in a subsidiary scanning direction, etc. The aforementioned ink is stored in an ink cartridge 7 that is provided as a liquid supply source. The ink cartridge 7 is detachably attached to the recording head 3. Note that a configuration in which an ink cartridge is disposed on a main body side of the printer and the ink is supplied from the ink cartridge to the recording head via an ink supply tube can also be adopted.

The carriage moving mechanism 5 includes a timing belt 8. The timing belt 8 is driven by an electric pulse motor 9 such as a direct-current (DC) motor. Therefore, when the electric pulse motor 9 is actuated, the carriage 4 is moved back and forth in the main scanning directions (along a width direction of the recording medium 2) while being guided by a guide rod 10 that extends in the printer 1. The location of the carriage 4 in the main scanning directions is detected by a linear encoder (not depicted) that is a kind of a location information detection unit. The linear encoder sends a detection signal, that is, an encoder pulse (a kind of location information), to a control section of the printer 1.

Figure 2:
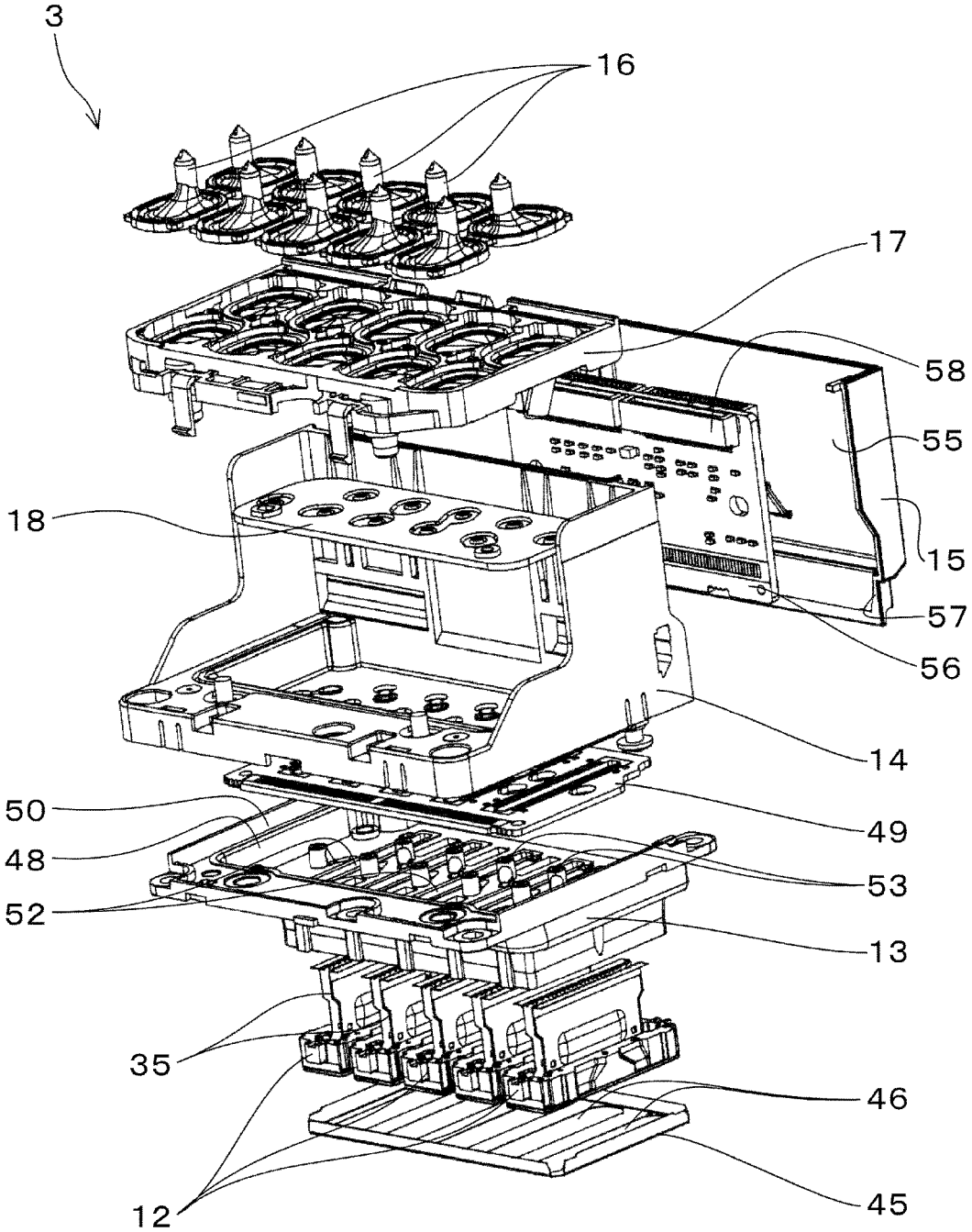
FIG. 2 is an exploded perspective view of a recording head.
Figure 3:
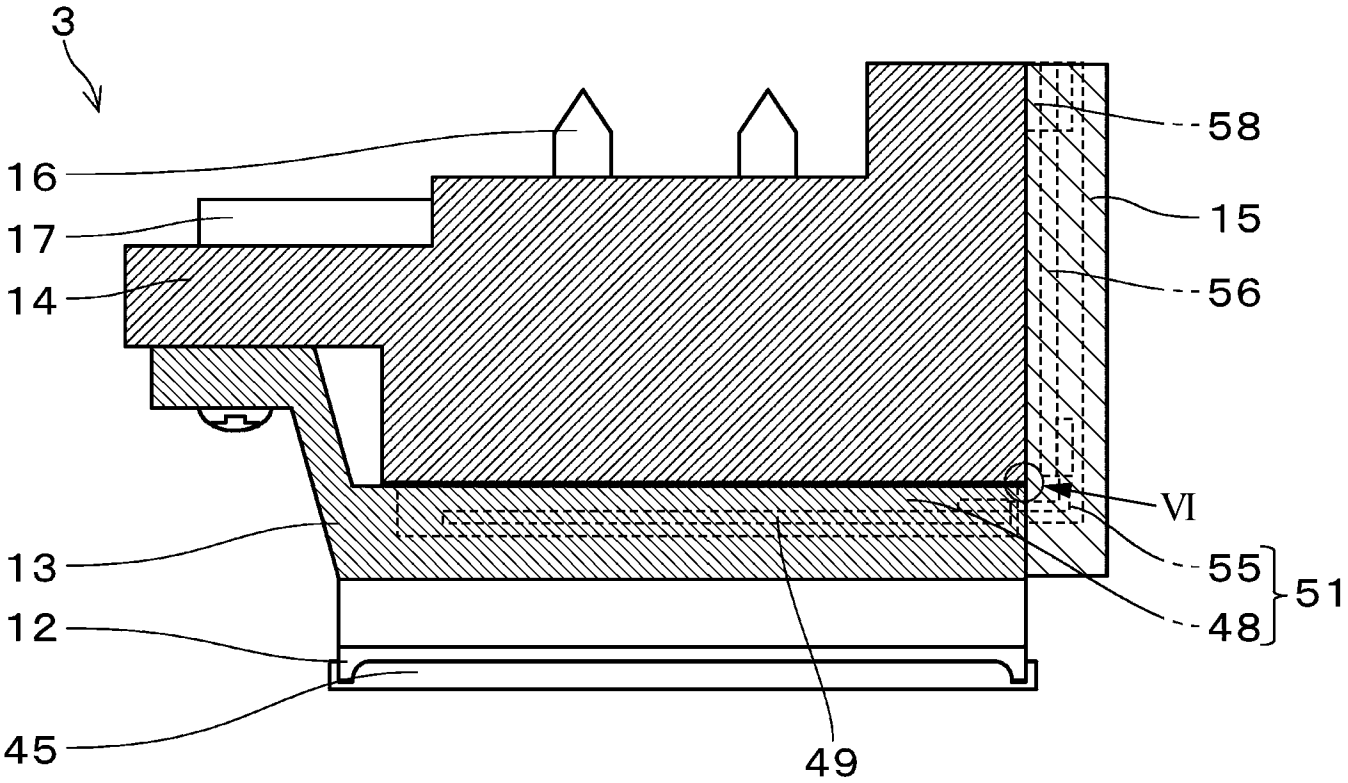
FIG. 3 is a sectional view of the recording head.
Figure 4:
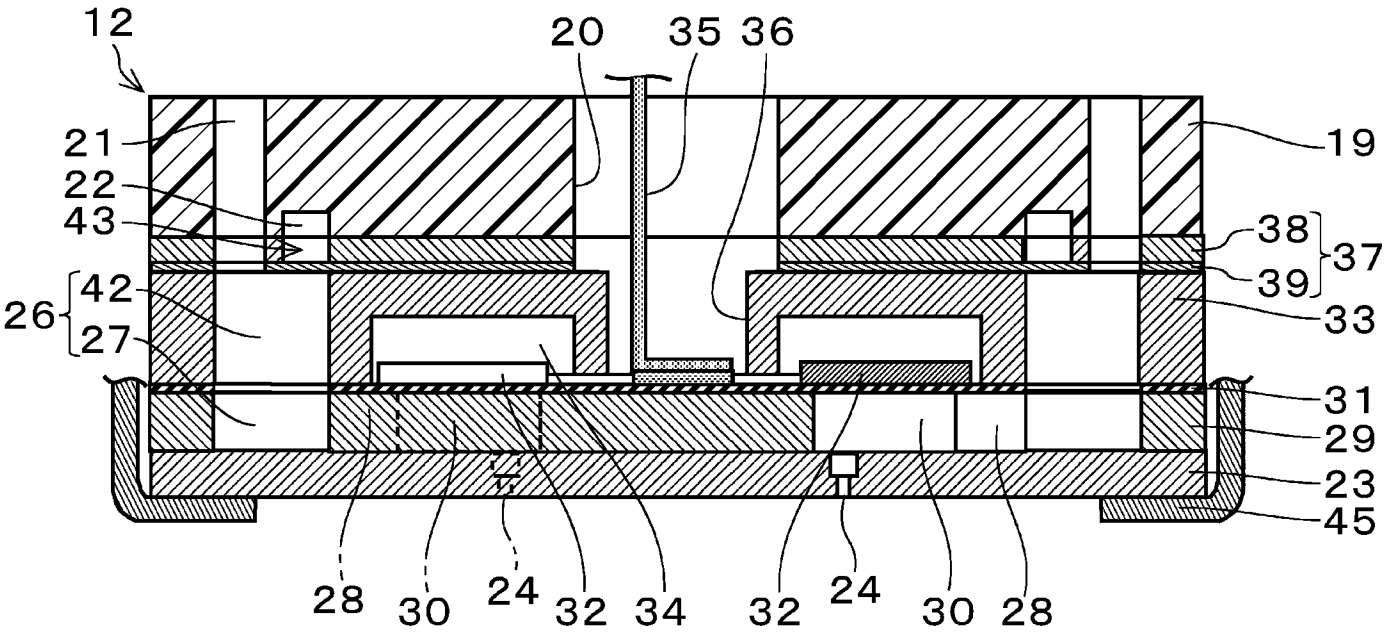
FIG. 4 is a sectional view of a head body.

Next, the recording head 3 will be described. FIG. 2 is an exploded perspective view of the recording head 3. FIG. 3 is a sectional schematic diagram of an end portion of the recording head 3. FIG. 4 is a schematic sectional diagram of a head body 12. In the following description, a direction in which various members are stacked will be referred to as an up-down direction.

The recording head 3 according to this exemplary embodiment, as illustrated in FIG. 2 and FIG. 3, includes the head body 12 that ejects an ink, a head fixing member 13 (corresponding to a first member in the invention) to which at least one head body 12 (five head bodies 12 in this exemplary embodiment) is fixed, a base member 14 (corresponding to a second member in the invention) provided on an upper side of the head fixing member 13 (on the opposite side thereof to the head bodies 12), a protective member 15 (corresponding to a third member in the invention) that is attached to side surfaces of the head fixing member 13 and the base member 14, a needle holder 17 to which supply needles 16 are attached, etc.

Each supply needle 16 is a hollow needle-shaped member inserted into the ink cartridge 7. A distal end portion of each supply needle 16 has an introduction hole (not depicted). Ink in the ink cartridge 7 is introduced to the recording head 3 through the introduction hole. In this exemplary embodiment, ten supply needles 16 are attached to an upper surface of the needle holder 17. The needle holder 17 has therein flow paths (not depicted) that communicate with the supply needles 16. The needle holder 17 is fixed to the base member 14 disposed that is disposed on a lower surface side of the needle holder 17 (on the opposite side thereof to the supply needles 16) via a sealing member 18. That is, the sealing member 18 is sandwiched between the needle holder 17 and the base member 14. The sealing member 18 is made up of an elastic body of, for example, an elastomer or a rubber, and provides a liquid-tight communication between flow paths within the needle holders 17 and corresponding flow paths (not depicted) provided within the base member 14.

The head fixing member 13, as illustrated in FIGS. 2 and 3, is disposed so that the base member 14 is attached to an upper surface side of the head fixing member 13 and the head bodies 12 are held on a lower surface side of the head fixing member 13 (i.e., a portion thereof apart from the portion thereof to which the base member 14 is joined and also apart from a portion thereof to which the protective member 15 is joined). In this exemplary embodiment, the head fixing member 13 has on its upper surface a first accommodating recess portion 48 that sinks downward halfway in the thickness of the head fixing member 13. A first circuit substrate 49 is housed in the first accommodating recess portion 48. In other words, the first accommodating recess portion 48 is surrounded by a first partition wall 50 extending upward from a bottom surface of the first accommodating recess portion 48. In this exemplary embodiment, the first partition wall 50 is provided on three of four sides around the first accommodating recess portion 48, that is, three sides other than a side to which the protective member 15 is attached. That is, the first accommodating recess portion 48 has an opening in a side surface on the side to which the protective member 15 is attached. Furthermore, the first accommodating recess portion 48 has an upper surface-side opening closed and sealed by the base member 14 and a protective member 15-side opening covered by the protective member 15. The first accommodating recess portion 48 communicates with a second accommodating recess portion 55 (described later) of the protective member 15 and forms together therewith a accommodating space 51 (corresponding to a space in the invention). The first circuit substrate 49 is sealed in the accommodating space 51. With regard to joining portions of the base member 14, the head fixing member 13, and the protective member 15, a detailed description will be given later.

An interior of the head fixing member 13 is provided with substrate insertion holes 52 that individually correspond to the head bodies 12 and that penetrate the head fixing member 13 in its thickness direction. An upper end of each substrate insertion hole 52 has an opening in a bottom surface of the first accommodating recess portion 48. In this exemplary embodiment, five substrate insertion holes 52 are provided corresponding to the five head bodies 12. Flexible substrates 35 (described later) extending out of the head bodies 12 are inserted through the substrate insertion holes 52 and connected to the first circuit substrate 49 that is disposed in the first accommodating recess portion 48.

Furthermore, an interior of the head fixing member 13 is provided with a plurality of ink flow paths 53. An upper end portion of each ink flow path 53 stands upward from the bottom surface of the first accommodating recess portion 48 and is connected to corresponding flow paths that are provided within the base member 14. The first circuit substrate 49 is provided with through holes (not depicted) corresponding to the ink flow paths 53 that stand upward in the first accommodating recess portion 48. Therefore, the upper end portions of the ink flow paths 53 are able to communicate with the corresponding flow paths provided within the base member 14, without being impeded by the first circuit substrate 49. Lower end portions of the ink flow paths 53 are connected to liquid introducing paths 21 of the head bodies 12 (described later).

The protective member 15 is disposed along a side of the head fixing member 13 and the base member 14 (along the right side of the two members in FIGS. 2 and 3) and attached to side surfaces of the head fixing member 13 and the base member 14 on that side. This protective member 15 is provided with the second accommodating recess portion 55 of which a base member 14 side (or a head fixing member 13 side) and an upper side (i.e., the side remote from the head bodies 12) are open. That is, the second accommodating recess portion 55 is surrounded by a second partition wall 57 that stands on edges of three sides of four sides of a face of the second accommodating recess portion 55 which faces the side surface of the head fixing member 13 and the side surface of the base member 14. The second accommodating recess portion 55 has a base member 14-side opening closed and sealed by the head fixing member 13 and the base member 14. A lower end portion of the base member 14-side opening communicates with the first accommodating recess portion 48 and forms together therewith the accommodating space 51. In short, the accommodating space 51 is surrounded by the head fixing member 13, the base member 14, the protective member 15, and adhesive adhering these members (concretely, a first adhesive 59 and a second adhesive 60 described later).

In this exemplary embodiment, the second accommodating recess portion 55 houses therein a second circuit substrate 56. In other words, the second circuit substrate 56 is disposed between the protective member 15 and the base member 14. Specifically, the second circuit substrate 56 is disposed on the side surface of the base member 14, and the protective member 15 is attached so as to cover the second circuit substrate 56. Thus, the second circuit substrate 56 can be protected by the protective member 15. The second circuit substrate 56 is connected at its lower end portion (concretely, at a communicating portion between the first accommodating recess portion 48 and the second accommodating recess portion 55) to the first circuit substrate 49. Note that the first circuit substrate 49 and the second circuit substrate 56 can be directly connected, for example, by coupling connectors provided on the two substrates, or indirectly connected via a wiring member or the like. A connector 58 is provided on an upper end portion of the second circuit substrate 56. The connector 58 is exposed to the upper side opening of the second accommodating recess portion 55 and is therefore connectable to external wiring. That is, the accommodating space 51 has an opening that is formed at a side of the base member 14 and above the recording head 3 so as to expose the connector 58. Thus, although the accommodating space 51 has an opening above the recording head 3, ink is unlikely to enter an interior of the accommodating space 51 because the side to which ink is ejected (discharged) is downward from the recording head 3. Note that, of the opening portion of the accommodating space 51, a portion around the connector 58 may be closed by a resin or the like. That is, the accommodating space 51 may be tightly sealed. In this manner, entrance of ink into the accommodating space 51 can be more certainly inhibited.

Next, the head bodies 12 will be described. In this exemplary embodiment, each of the head bodies 12, as illustrated in FIG. 4, has a configuration in which a nozzle plate 23, a flow path substrate 29, piezoelectric elements 32 (a kind of actuator), a closure plate 33, a compliance substrate 37, etc. are stacked, and is mounted in a head case 19.

In this exemplary embodiment, the head case 19 is a box-shaped member made of a synthetic resin. As illustrated in FIG. 4, a central portion of the head case 19 is provided with an insertion space 20 that is elongated along a nozzle row direction. The insertion space 20 is a space into which the flexible substrate 35 is inserted and which penetrates the head case 19 in its plate thickness direction. The insertion space 20 communicates with a connecting space 36 of the closure plate 33 that is joined below the head case 19. Inside the head case 19 there are provided liquid introducing paths 21 through which ink flows. Lower ends of the liquid introducing paths 21 connect to common liquid chambers 26 described below. In this exemplary embodiment, the liquid introducing paths 21 are formed at both sides of the insertion space 20 in a direction orthogonal to the nozzle row direction. In a lower surface of the head case 19, portions that face the common liquid chambers 26 are each provided with a compliance space 22 that is formed so as not to inhibit flexible deformation of a closure film 39 that demarcates an upper surface of the adjacent common liquid chamber 26.

The flow path substrate 29 on which the piezoelectric elements 32 lie is a substrate made of silicon (e.g., a silicon single crystal substrate) that is elongated along the nozzle row direction. As illustrated in FIG. 4, the flow path substrate 29 is provided with two communicating portions 27 elongated in a longitudinal direction of the flow path substrate 29. Each communicating portion 27 communicates with a corresponding one of through hole portions 42 of the closure plate 33 and forms together therewith a common liquid chamber 26. In a portion of the flow path substrate 29 sandwiched between the two communicating portions 27 there are plurality of pressure chambers 30 that are provided side by side along the nozzle row direction. The pressure chambers 30 are arranged in two rows corresponding to the two communicating portions 27. Each pressure chamber 30 communicates with the adjacent communicating portion 27 via a corresponding one of supply paths 28 that have a narrower width than the pressure chambers 30. The two rows of the pressure chambers 30 are shifted from each other in position in the nozzle row direction by half an arrangement pitch corresponding to an arrangement of nozzles 24.

The nozzle plate 23 is fixed to a lower surface of the flow path substrate 29 (an opposite side surface thereof to the piezoelectric elements 32) via an adhesive or the like. The nozzle plate 23 is made of a silicon substrate (e.g., a silicon single crystal substrate) and provided with a plurality of nozzles 24 that are formed in the nozzle plate 23 so as to communicate one-to-one with the pressure chambers 30. Specifically, in the nozzle plate 23, the nozzles 24 (hereinafter, sometimes referred to as rows of nozzles) are provided (formed) side by side linearly (in other words, in rows) in the longitudinal direction of the nozzle plate 23. The nozzles 24 (rows of nozzles) formed side by side are aligned equidistantly with a pitch that corresponds to a dot formation density, from a nozzle 24 at an end to a nozzle 24 at the opposite end in the longitudinal direction. In this exemplary embodiment, two nozzle rows are formed corresponding to the two rows of the pressure chambers 30. The two nozzle rows are shifted in position from each other by half the pitch in an arrangement direction of the nozzles 24 (i.e., a nozzle row direction). More specifically, the nozzles 24 of one of the two rows and the nozzles 24 of the other row are shifted in position in the nozzle row direction so as to alternate with each other.

A vibrations plate 31 lies on an upper surface of the flow path substrate 29 (the opposite surface thereof to the nozzle plate 23). The vibration plate 31 is made up of, for example, an elastic film formed from silicon dioxide ($SiO_2$) on the upper surface of the flow path substrate 29 (i.e., the opposite surface thereof to the closure plate 33) and an insulator film formed from zirconium dioxide ($ZrO_2$) on the elastic film. This vibration plate 31 closes and seals upper openings of spaces that are to form the pressure chambers 30. In other words, the vibration plate 31 demarcates an upper surface of the pressure chamber 30. Portions of the vibration plate 31 that correspond to the pressure chambers 30 (more specifically, the upper openings of the pressure chambers 30) function as displacement portions that are displaced in a direction away from or toward a nozzle 24 as a corresponding one of the piezoelectric elements 32 flexurally deforms. Specifically, portions of the vibration plate 31 that correspond to the upper openings of the pressure chambers 30 serve as drive regions that are permitted to flexurally deform.

Deformation (displacement) of the drive region (displacement portion) changes the volume of the pressure chamber 30 and therefore causes pressure changes in the ink in the pressure chamber 30. By utilizing such pressure changes, ink inside the pressure chamber 30 can be ejected through the nozzle 24. Of the vibration plate 31, portions that correspond to the communicating portions 27 have been removed to form openings.

In the upper surface of the vibration plate 31 (more specifically, the opposite surface of the vibration plate 31, more concretely, the insulation film, to the flow path substrate 29), regions that correspond to the pressure chambers 30 are provided with the piezoelectric elements 32 laid thereon. In this exemplary embodiment, the piezoelectric elements 32 are so-called flexure mode piezoelectric elements. The piezoelectric elements 32 are aligned side by side in the nozzle row direction, corresponding individually to the nozzles 24. Each of the piezoelectric elements 32 is formed by, for example, a lower electrode layer that forms an individual electrode, a piezoelectric body layer, and an upper electrode layer that forms a common electrode are sequentially stacked in that order from the surface of the vibration plate 31. Note that, depending on conditions of a drive circuit or wiring, the lower electrode layer may be formed as a common electrode and the upper electrode layer may be formed as an individual electrode. As for each piezoelectric element 32 configured as described above, when an electric field according to a potential difference between the lower electrode layer and the upper electrode layer is applied between the two electrodes, the piezoelectric element 32 flexurally deforms in a direction away from the nozzle 24 or a direction toward the nozzle 24. Lead wires (not depicted) extend out from the piezoelectric elements 32 toward a region on the vibration plate 31 between the two rows of pressure chambers 30 (i.e., between the two rows of piezoelectric elements 32). An opposite end portion of each lead wire to the piezoelectric element 32 is connected to the flexible substrate 35.

The closure plate 33 is joined to the upper surface of the vibration plate 31 and has, in regions adjacent to the piezoelectric elements 32, piezoelectric element accommodating spaces 34 whose size is such as not to inhibit the displacement of the piezoelectric elements 32. Corresponding to the two rows of the piezoelectric elements 32, two piezoelectric element accommodating spaces 34 are formed. Between the two piezoelectric element accommodating spaces 34, a connecting space 36 is formed by removing a corresponding portion of the closure plate 33 that extends across the plate thickness of the closure plate 33. The connecting space 36 communicates with the insertion space 20 of the head case 19. Inside the connecting space 36 there is disposed an end portion of the flexible substrate 35 inserted through the insertion space 20. The closure plate 33 has, at locations corresponding to the elongated communicating portions 27 of the flow path substrate 29, through hole portions 42 that penetrate the thickness of the closure plate 33 and that are elongated along the nozzle row direction. In this exemplary embodiment, two through hole portions 42 are provided corresponding to the two communicating portions 27. Each through hole portion 42 communicates with a corresponding one of the communicating portions 27 and forms together therewith a common liquid chamber 26. That is, the through hole portions 42 define spaces that form upper portions of the common liquid chambers 26.

The compliance substrate 37 seals upper surfaces of the through hole portions 42 and partitions the common liquid chambers 26. The compliance substrate 37 is made up of a stack of a closure film 39 having flexibility and a fixture substrate 38 made of a hard material such as a metal. In this exemplary embodiment, the compliance substrate 37 is joined to the upper surface of the closure plate 33, in a posture with the closure film 39 disposed at a lower side (i.e., at the closure plate 33 side). The compliance substrate 37 has, at locations corresponding to the insertion space 20, an opening that penetrates the thickness of the compliance substrate 37 so as to provide communication between the insertion space 20 and the connecting space 36. Furthermore, at locations on the compliance substrate 37 which correspond to the liquid introducing paths 21, openings penetrate the thickness of the compliance substrate 37 so as to provide communication between the liquid introducing paths 21 and the common liquid chambers 26. Of the portions of the compliance substrate 37 that face the common liquid chambers 26, portions other than the openings that provide communication between the liquid introducing path 21 and the common liquid chamber 26 are formed as closure portions 43 that are made up of only the closure film 39 by removing the fixture substrate 38. Each closure portion 43 functions as a compliance portion that absorbs pressure changes in the ink within an adjacent one of the common liquid chambers 26.

As illustrated in FIGS. 2 to 4, a fixture plate 45 is attached to lower surfaces of the head bodies 12 (i.e., lower surfaces of the nozzle plates 23). In this exemplary embodiment, the fixture plate 45 is produced from a plate member that has electroconductivity, such as a stainless steel plate, and is bent upward (to the head fixing member 13 side) at locations apart from the nozzle plates 23. A portion of the fixture plate 45 that is parallel to the nozzle plates 23 is provided with a plurality of nozzle exposing openings 46 corresponding to the head bodies 12. The fixture plate 45 is in contact with peripheral edge portions of the nozzle plate 23, with the nozzle exposing openings 46 exposing the nozzles 24. Due to this arrangement, the fixture plate 45 and the nozzle plates 23 are electrically connected.

Figure 5:
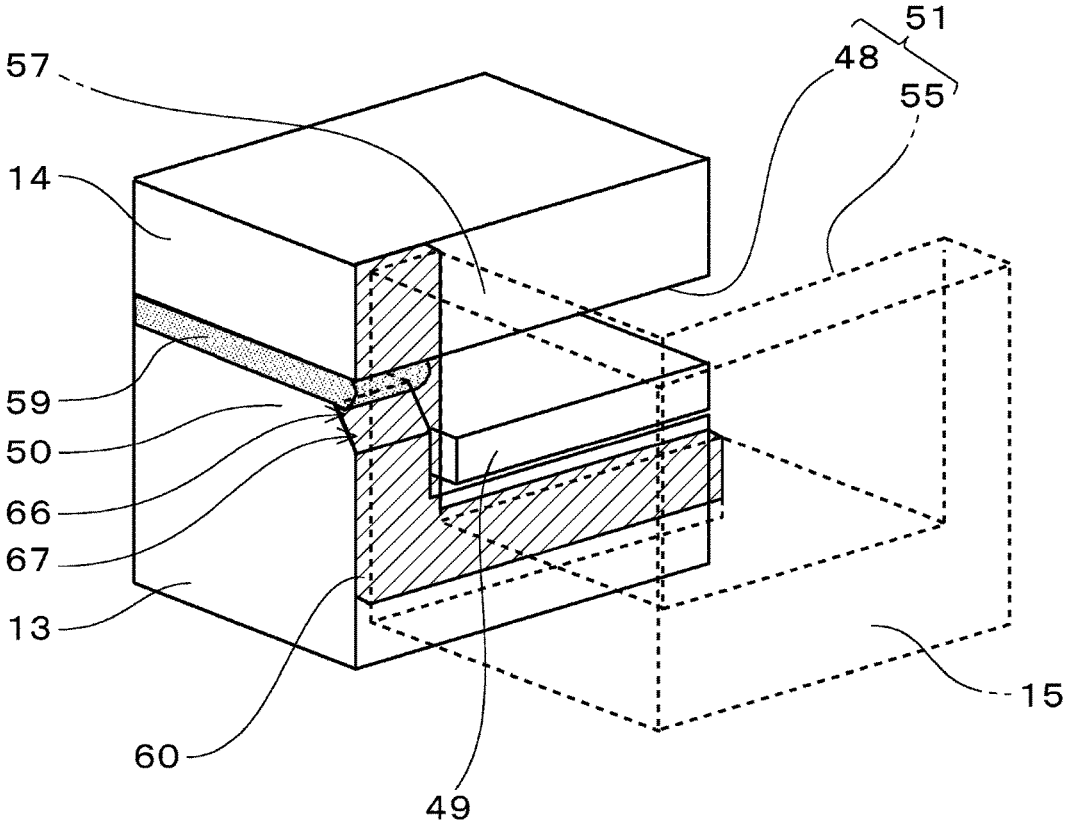
FIG. 5 is an enlarged perspective view of portions of the recording head.
Figure 6:
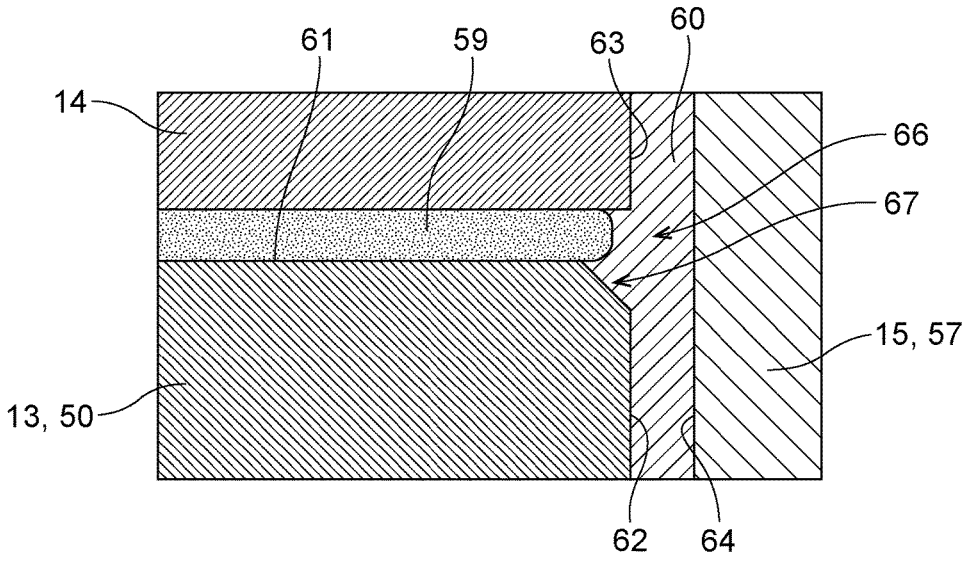
FIG. 6 is an enlarged view of a region VI indicated in FIG. 3.

Next, joining portions between the base member 14, the head fixing member 13, and the protective member 15 will be described. FIG. 5 is an enlarged perspective view of portions of the recording head 3. FIG. 6 is an enlarged view of a region VI illustrated in FIG. 3. That is, FIG. 6 is an enlarged sectional view of portions of the recording head 3. In FIG. 5, the protective member 15 is indicated by interrupted lines.

As illustrated in FIG. 5 and FIG. 6, the base member 14 and the head fixing member 13 are adhered to each other by a first adhesive 59. Concretely, the first adhesive 59 adheres a flat upper surface of the head fixing member 13, that is, an upper surface of the first partition wall 50 (hereinafter, referred to as first surface 61), and a flat lower surface of the base member 14. In short, the base member 14 is adhered to the first surface 61 of the head fixing member 13 by the first adhesive 59. In this exemplary embodiment, the first adhesive 59 is provided in an outer perimeter region around the first accommodating recess portion 48. That is, the base member 14 and the head fixing member 13 are adhered by the first adhesive 59, on three sides of the four sides around the first accommodating recess portion 48, the three sides being other than the side to which the protective member 15 is attached. Thus, an outer perimeter region around the first accommodating recess portion 48, excluding the protective member 15-side opening, is sealed.

Furthermore, the base member 14 and the head fixing member 13 are adhered to the protective member 15 by a second adhesive 60. Concretely, the second adhesive 60 adheres a protective member 15-side flat side surface of the head fixing member 13, that is, a surface thereof that intersects (orthogonally in this exemplary embodiment) the first surface 61 (which hereinafter will be referred to as second surface 62), and a protective member 15-side flat side surface of the base member 14, that is, a surface thereof extending substantially flush or parallel with the second surface 62 (which hereinafter will be referred to as third surface 63), and a base member 14-side (or head fixing member 13-side) flat surface of the protective member 15, that is, an end surface of the second partition wall 57 (which hereinafter will be referred to as fourth surface 64). In short, the fourth surface 64 of the protective member 15 is disposed along the second surface 62 and the third surface 63, which extends in planar directions of the second surface 62, and is adhered to the second surface 62 and the third surface 63 by the second adhesive 60. In this exemplary embodiment, the second adhesive 60 is provided in an outer perimeter region around the second accommodating recess portion 55. That is, the second surface 62 and the third surface 63 are adhered to the fourth surface 64 by the second adhesive 60, on three sides of the four sides around the second accommodating recess portion 55, the three sides being other than the upper side of the second accommodating recess portion 55. Thus, the second accommodating recess portion 55, which is in communication with the first accommodating recess portion 48, is sealed on its outer perimeter region, except the upper opening of the second accommodating recess portion 55. Therefore, the accommodating space 51, except its upper opening, is closed and sealed by the head fixing member 13, the base member 14, the protective member 15, the first adhesive 59, and the second adhesive 60.

A portion that includes an intersection portion 66 at which the first adhesive 59 and the second adhesive 60 substantially intersect each other (i.e., an intersection portion 66 at which a joining surface between the head fixing member 13 and the base member 14 and a joining surface of the head fixing member 13 and the base member 14 with the protective member 15 intersect each other, that is, an intersection portion 66 across which the head fixing member 13 and the base member 14 face each other, the head fixing member 13 and the protective member 15 face each other, and the base member 14 and the protective member 15 face each other) is provided with an adhesive receiving space 67 (corresponding to an adhesive receiving portion in the invention) which communicates with the intersection portion 66 and into which at least one of the first adhesive 59 and the second adhesive 60 can flow. In this exemplary embodiment, the adhesive receiving space 67 is formed by obliquely chamfering the head fixing member 13 from a first surface 61 side toward a second surface 62 side (i.e., a third member side). In other words, a corner portion of the head fixing member 13 at which the first surface 61 and the second surface 62 intersect (a second surface 62-side edge of the first surface 61) is chamfered, that is, beveled, to provide the corner portion with the adhesive receiving space 67. Thus, since the adhesive receiving space 67 is formed by chamfering, it becomes easy to form the adhesive receiving space 67 and therefore it becomes easy to manufacture the head fixing member 13. Note that in this exemplary embodiment, the chamfer is formed so as to slope downward at an angle of substantially 45 degrees to the first surface 61.

The adhesive receiving space 67 is a space that is filled with either one or both of the first adhesive 59 and the second adhesive 60 depending on variations in the amount of the first adhesive 59 (the amount applied). That is, which of the adhesives fills the adhesive receiving space 67 changes depending on the amount of the first adhesive 59 (the amount applied) at the time of fixing the head fixing member 13 and the base member 14 to each other. For example, when the amount of the first adhesive 59 is small, e.g., a designed lower-limit value, the first adhesive 59 substantially does not flow into the adhesive receiving space 67 and the adhesive receiving space 67 is filled with the second adhesive 60. On the other hand, when the amount of the first adhesive 59 is large, e.g., a designed upper-limit value, the first adhesive 59 flows into the adhesive receiving space 67 so as to substantially fill up the adhesive receiving space 67. Furthermore, when the amount of the first adhesive 59 is an intermediate value between the designed lower-limit value and the designed upper-limit value, the first adhesive 59 flows into a part of the adhesive receiving space 67 so as to partially fill the adhesive receiving space 67 and the other part of the adhesive receiving space 67 is filled with the second adhesive 60. Note that the first adhesive 59 and the second adhesive 60 may be the same adhesive or different adhesives. The first adhesive 59 and the second adhesive 60 may be, for example, an epoxy-based adhesive, a silicon-based adhesive, etc. In short, the first adhesive 59 and the second adhesive 60 may be any adhesive as long as the adhesive is in a liquid state before hardening.

Figure 7:
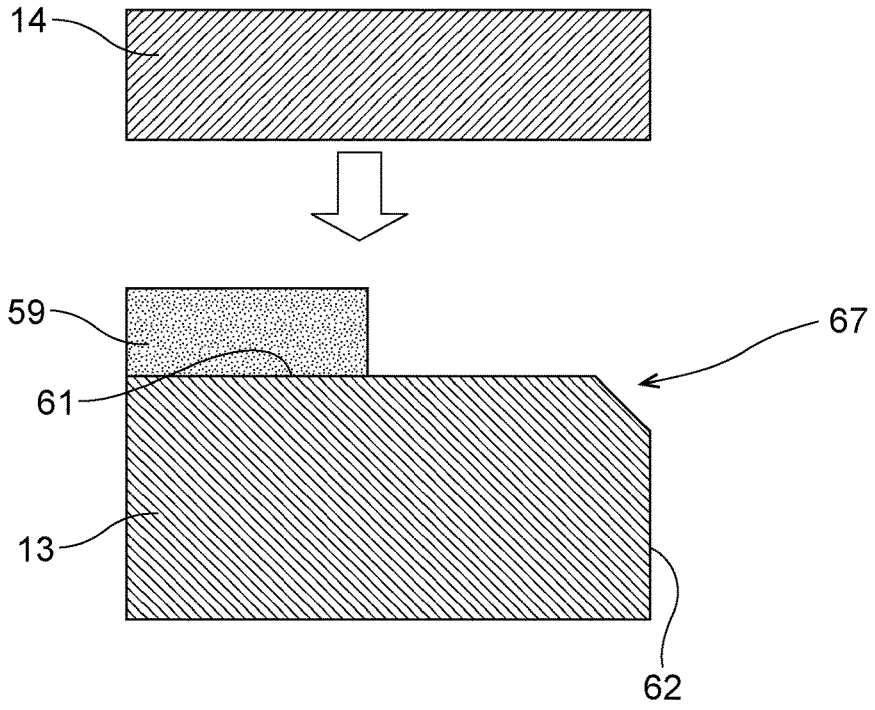
FIG. 7 is a sectional view describing a production method for a recording head.
Figure 8:
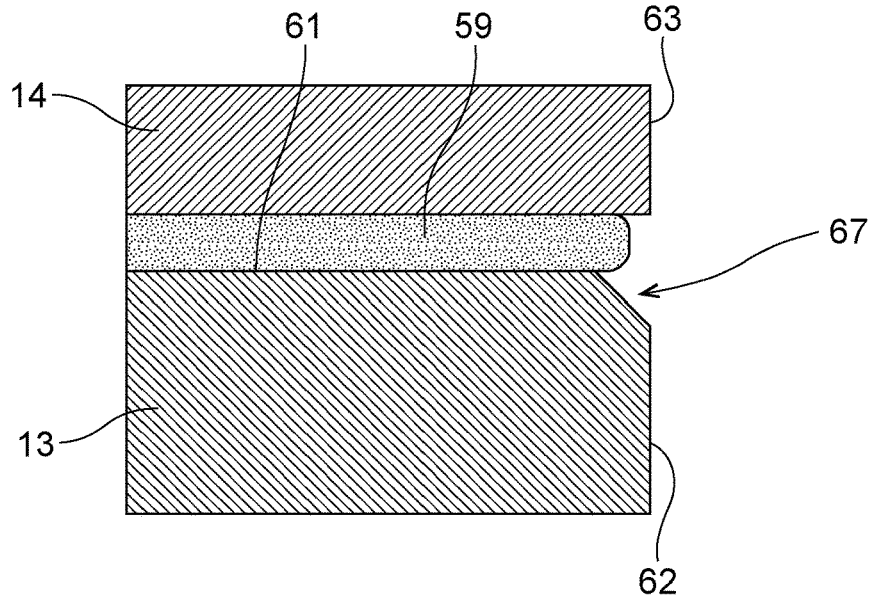
FIG. 8 is a sectional view illustrating the production method for the recording head.
Figure 9:
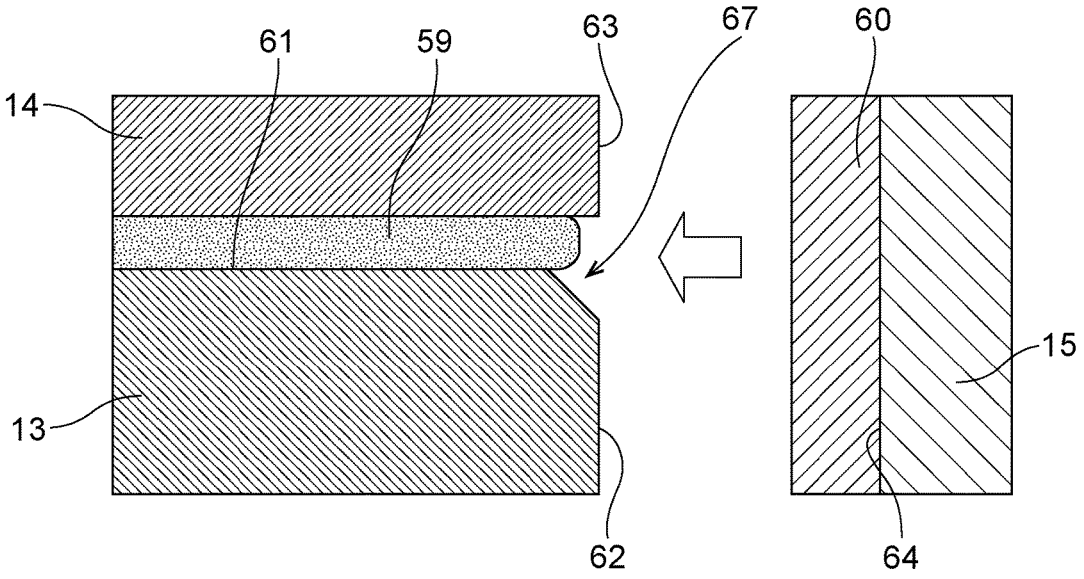
FIG. 9 is a sectional view illustrating the production method for the recording head.

Next, a production method for the recording head 3, in particular, a method for joining the head fixing member 13, the base member 14, and the protective member 15, will be described in detail. FIGS. 7 to 9 are sectional views of portions illustrating a production method for the recording head 3.

First, the head bodies 12 and the like are fixed to the head fixing member 13, the first circuit substrate 49 is disposed in the first accommodating recess portion 48, and the flexible substrates 35 are connected to the first circuit substrate 49. Then, the process proceeds to a first adhering step of adhering the head fixing member 13 and the base member 14 to each other. Specifically, first, the first adhesive 59 in a state prior to hardening is applied to the head fixing member 13 (concretely, to the first surface 61, which defines side edges of the first accommodating recess portion 48). Next, as illustrated in FIG. 7, either one or both of the head fixing member 13 and the base member 14 are moved relatively to each other in such a direction (see an arrow in FIG. 7) that the base member 14 approaches the head fixing member 13. Thus, the head fixing member 13 and the base member 14 are adhered to each other, with the first adhesive 59 sandwiched therebetween. Specifically, until a predetermined time needed for the first adhesive 59 to harden elapses, relative positions of the head fixing member 13 and the base member 14 are maintained. At this time, as illustrated in FIG. 8, the first adhesive 59 is pressed and spread between the head fixing member 13 and the base member 14 so as to occupy a predetermined location between the head fixing member 13 and the base member 14 and fill a space therebetween. Note that even if the amount of the first adhesive 59 happens to be large due to variation in the application of the adhesive, some of the first adhesive 59 flows into the adhesive receiving space 67, so that the first adhesive 59 can be inhibited from squeezing out to the outer sides of the head fixing member 13 and the base member 14. In the exemplary embodiment, although in the first adhering step, the first adhesive 59 is applied to the head fixing member 13 side, this is not restrictive. For example, the first adhesive 59 may be applied to the base member 14 side or may also be applied to both the head fixing member 13 side and the base member 14 side.

After the head fixing member 13 and the base member 14 are adhered together in the first adhering step, the second circuit substrate 56 is connected to the first circuit substrate 49 and the second circuit substrate 56 is attached to the side surface of the base member 14. Next, the process proceeds to a second adhering step of adhering the head fixing member 13 and the base member 14 to the protective member 15. Specifically, first, the second adhesive 60 in a state prior to hardening is applied to the protective member 15 (concretely, to the fourth surface 64, which defines side edges of the second accommodating recess portion 55). Then, as illustrated in FIG. 9, either a stacked member obtained by stacking the head fixing member 13 and the base member 14 or the protective member 15 or both of them are moved relatively to each other in such a direction (see an arrow in FIG. 9) that the protective member 15 approaches the head fixing member 13 (or the base member 14). Thus, the head fixing member 13 and the base member 14 are adhered to the protective member 15, with the second adhesive 60 sandwiched therebetween. That is, until a predetermined time needed for the second adhesive 60 to harden elapses, the relative positions of the protective member 15 and the stack of the head fixing member 13 and the base member 14 are maintained. At this time, the second adhesive 60 is pressed and spread between the protective member 15 and the head fixing member 13 and between the protective member 15 and the base member 14 so as to occupy predetermined locations between the head fixing member 13 and the protective member 15 and between the base member 14 and the protective member 15 and fill spaces therebetween. In the case where the adhesive receiving space 67 is not filled with the first adhesive 59, the second adhesive 60 flows into the adhesive receiving space 67 (in the case where the first adhesive 59 has flown into and hardened in a portion of the adhesive receiving space 67, the second adhesive 60 flows into the rest of the adhesive receiving space 67) so that the adhesive receiving space 67 is filled. On the other hand, in the case where the adhesive receiving space 67 is already filled with the first adhesive 59, the second adhesive 60 fills a space between the head fixing member 13 and the protective member 15 and a space between the base member 14 and the protective member 15 so as to cover the first adhesive 59. In this manner, the adhesive receiving space 67 is filled with adhesive (either one or both of the first adhesive 59 and the second adhesive 60) That is, in the intersection portion 66, the first adhesive 59 and the second adhesive 60 are continuous without a gap. In the exemplary embodiment, although in the second adhering step, the second adhesive 60 is applied to the protective member 15 side, this is not restrictive. For example, the second adhesive 60 may be applied to the head fixing member 13 and the base member 14 or may also be applied to the head fixing member 13, the base member 14, and the protective member 15.

Because the adhesive receiving space 67 is formed between the head fixing member 13 and the base member 14, an excess amount of the first adhesive 59 applied to adhere the head fixing member 13 and the base member 14, if there is any excess, will flow into the adhesive receiving space 67, so that the first adhesive 59 can be inhibited from squeezing out to the outsides of the head fixing member 13 and the base member 14. Therefore, the amount of the first adhesive 59 can be increased so that the first adhesive 59 more easily fills the joining portion between the head fixing member 13 and the base member 14. As a result, it is possible to inhibit formation of a gap between the head fixing member 13 and the base member 14. Furthermore, even when the amount of the first adhesive 59 happens to be small due to variation or the like so that the first adhesive 59 hardly flows into the adhesive receiving space 67, the second adhesive 60 flows into and fills the adhesive receiving space 67, so that formation of a gap in the intersection portion 66 can be inhibited. Thus, a periphery of the accommodating space 51 surrounded by the head fixing member 13, the base member 14, and the protective member 15 is sealed by the first adhesive 59 and the second adhesive 60 so that entrance of undesired matters, such as ink or dust, into the accommodating space 51 from outside the recording head 3 can be inhibited. Therefore, the staining and spoiling of the first circuit substrate 49 and the second circuit substrate 56 disposed in the accommodating space 51 can be inhibited.

Finally, the base member 14, the needle holder 17, etc. are attached to complete making the recording head 3. Note that the production method for the recording head 3 is not limited to the foregoing method but may be any method as long as the method includes performing the first adhering step in which the head fixing member 13 and the base member 14 are adhered and then performing the second adhering step in which the head fixing member 13 and the base member 14 are adhered to the protective member 15. For example, after the first adhering step, the head bodies 12, the first circuit substrate 49, etc., may be attached to the head fixing member 13. Furthermore, before the second adhering step, the base member 14, the needle holder 17, etc. may be attached.

When the first adhesive 59 and the second adhesive 60 are different adhesives, it is desirable that the second adhesive 60 in the liquid state have lower viscosity than the first adhesive 59 in the liquid state. That is, it is desirable that the viscosity of the second adhesive 60 in the liquid state prior to hardening be lower than the viscosity of the first adhesive 59 in the liquid state prior to hardening. Due to this desirable setting, when the protective member 15 is adhered in the second adhering step, it is easier for the second adhesive 60 to fill a space between the head fixing member 13 and the base member 14 which includes the adhesive receiving space 67 and which is not filled with the first adhesive 59. As a result, formation of a gap between the head fixing member 13 and the base member 14 can be more certainly inhibited.

Figure 10:
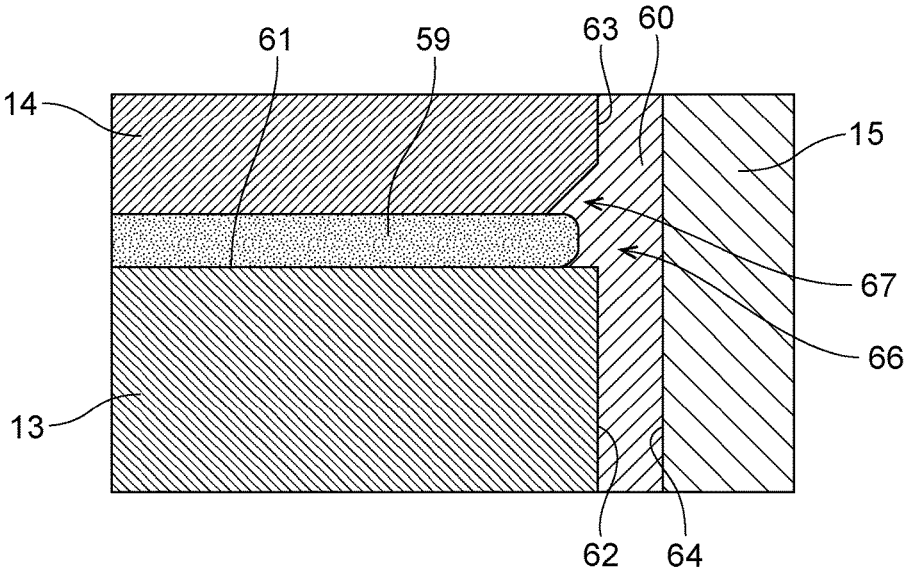
FIG. 10 is an enlarged sectional view of portions of a recording head according to a second exemplary embodiment of the invention.

The configuration of the adhesive receiving space 67 is not limited to the configuration illustrated above as an example in conjunction with the first exemplary embodiment but various other configurations can also be adopted for the adhesive receiving space 67. For example, an adhesive receiving space 67 in a second exemplary embodiment illustrated in FIG. 10 is formed by obliquely chamfering a base member 14 from the first surface 61 side toward the second surface 62 side (i.e., to the third member side). In other words, by chamfering a corner portion of the base member 14 at which the surface that is adhered to the first surface 61 of the head fixing member 13 intersects the third surface 63, a vicinity of the corner portion is provided with the adhesive receiving space 67. In this exemplary embodiment, this chamfer is formed with an obliquely ascending angle of substantially 45 degrees to the first surface 61. The adhesive receiving space 67 in this exemplary embodiment, similar to that in the first exemplary embodiment, is filled with adhesive (either one or both of the first adhesive 59 and the second adhesive 60). Thus, in this exemplary embodiment, too, since the adhesive receiving space 67 is formed between the head fixing member 13 and the base member 14, the first adhesive 59, even if applied in a large amount to adhere the head fixing member 13 and the base member 14, is inhibited from squeezing out to the outer sides of the head fixing member 13 and the base member 14. Therefore, the amount of the first adhesive 59 can be increased so that the first adhesive 59 more easily fills the joining portion between the head fixing member 13 and the base member 14. As a result, it is possible to inhibit formation of a gap between the head fixing member 13 and the base member 14. Incidentally, other configurations are the same as those in the foregoing first exemplary embodiment and will not be described again here.

Figure 11:
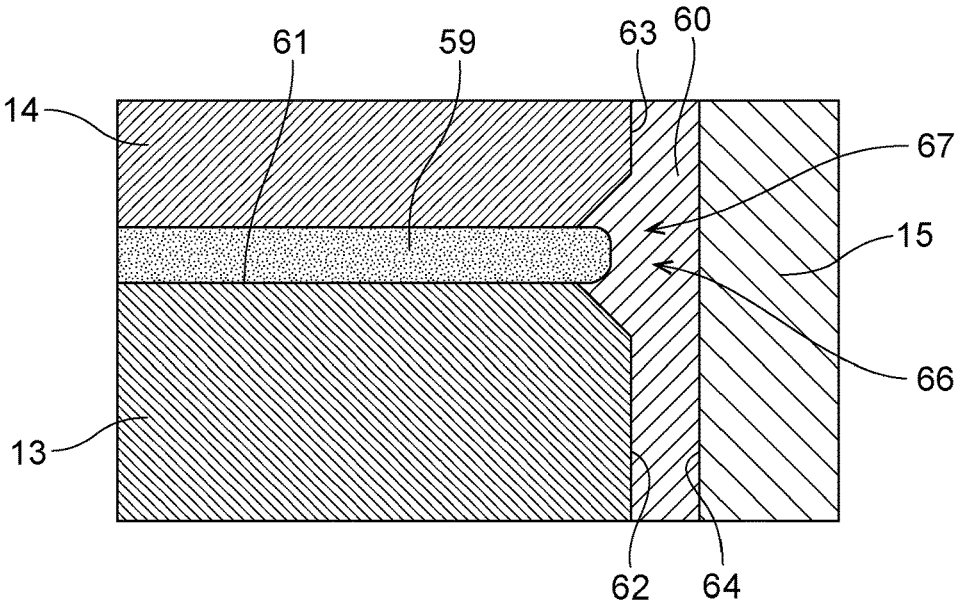
FIG. 11 is an enlarged sectional view of portions of a recording head according to a third exemplary embodiment.

An adhesive receiving space 67 in a third exemplary embodiment illustrated in FIG. 11 is formed by chamfering both a head fixing member 13 and a base member 14. Specifically, the head fixing member 13 is obliquely chamfered from the first surface 61 toward the second surface 62, and the base member 14 is obliquely chamfered from the first surface 61 side to the third surface 63 side. That is, in this exemplary embodiment, the adhesive receiving space 67 is a space extending from the head fixing member 13 to the base member 14. The chamfer of the head fixing member 13, similarly to that in the first exemplary embodiment, is formed with an obliquely descending angle of substantially 45 degrees to the first surface 61. The chamfer of the base member 14, similar to that in the second exemplary embodiment, is formed with an obliquely ascending angle of substantially 45 degrees to the first surface 61. Furthermore, the adhesive receiving space 67 in this exemplary embodiment, similar to that in the first exemplary embodiment, is filled with adhesive (either one or both of the first adhesive 59 and the second adhesive 60). According to this exemplary embodiment, an adhesive receiving space 67 having a large capacity can be easily formed. Since an increased amount of adhesive can be received by the adhesive receiving space 67, it is possible to inhibit the first adhesive 59 from squeezing out to the outer sides of the head fixing member 13 and the base member 14 even in the case where the amount of the first adhesive 59 varies to a great extent. Therefore, the amount of the first adhesive 59 can be further increased so that the first adhesive 59 even more easily fills the joining portion between the head fixing member 13 and the base member 14. As a result, it is possible to further inhibit formation of a gap between the head fixing member 13 and the base member 14. Incidentally, other configurations are the same as those in the foregoing first exemplary embodiment and will not be described again here.

Figure 12:
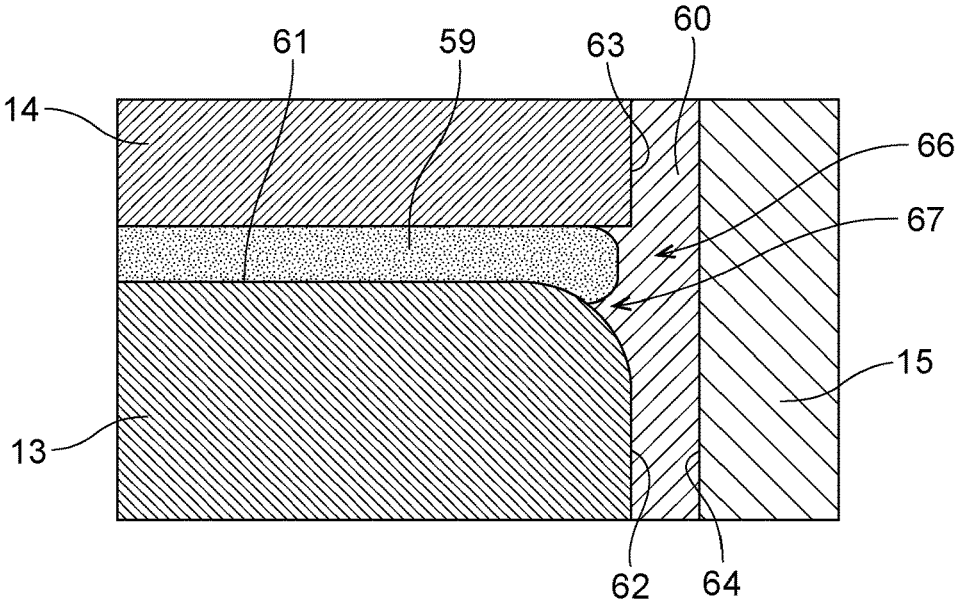
FIG. 12 is an enlarged sectional view of portions of a recording head according to a fourth exemplary embodiment.

An adhesive receiving space 67 in a fourth exemplary embodiment illustrated in FIG. 12 is formed by chamfering a head fixing member 13 into a round shape from the first surface 61 side toward the second surface 62 side. That is, in this exemplary embodiment, the chamfer has a curved surface. The adhesive receiving space 67 in this exemplary embodiment, similar to that in the foregoing first exemplary embodiment, is filled with adhesive (either one or both of the first adhesive 59 and the second adhesive 60). According to this exemplary embodiment, the first adhesive 59 or the second adhesive 60 easily flows along the curved surface into the adhesive receiving space 67. As a result, the adhesive receiving space 67 is more easily filled with either one or both of the first adhesive 59 and the second adhesive 60, so that formation of a gap between the head fixing member 13 and the base member 14 can be further inhibited. Incidentally, other configurations are the same as those in the foregoing first exemplary embodiment and will not be described again here. Note that the chamfer in the second exemplary embodiment and the chamfers in the third exemplary embodiment described above can also be formed into round shapes as in this exemplary embodiment.

Figure 13:
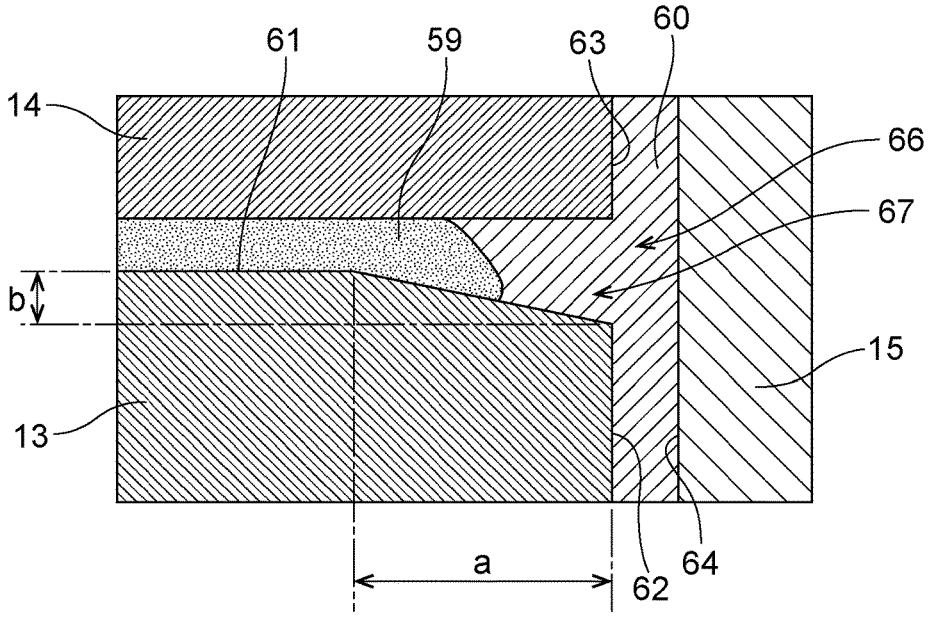
FIG. 13 is an enlarged sectional view of portions of a recording head according to a fifth exemplary embodiment.

A adhesive receiving space 67 in a fifth exemplary embodiment illustrated in FIG. 13 is formed by obliquely chamfering a head fixing member 13 from the first surface 61 side toward the second surface 62 side so that an opening width a on the first surface 61 side is larger than an opening width b on the second surface 62 side (i.e., the protective member 15 side). Note that the opening width a on the first surface 61 side (the first surface 61-side opening width a) mentioned herein is a dimension of an opening region facing the first surface 61 side of the adhesive receiving space 67 which is measured in a direction perpendicular to the second surface 62 (or a direction perpendicular to the fourth surface 64). In other words, the first surface 61-side opening width a is a distance between a first surface 61-side end of the chamfer and a second surface 62-side end of the same chamber which is measured in the direction perpendicular to the second surface 62. On the other hand, the opening width b on the second surface 62 side (the second surface 62-side opening width b) is a dimension of an opening region facing the second surface 62 side of the adhesive receiving space 67 which is measured in a direction perpendicular to the first surface 61. In other words, the second surface 62-side opening width b is a distance between the first surface 61-side end and the second surface 62-side end of the chamfer which is measured in the direction perpendicular to the first surface 61. In short, the chamfer in this exemplary embodiment has a gently descending slope with respect to the first surface 61. The adhesive receiving space 67 in this exemplary embodiment, similar to that in the foregoing first exemplary embodiment, is filled with adhesive (either one or both of the first adhesive 59 and the second adhesive 60). In this exemplary embodiment, since the first surface 61-side opening width a is larger than the second surface 62-side opening width b, the first surface 61-side end of the chamfer is located farther apart from the second surface 62 (from the protective member 15). That is, the adhesive receiving space 67 can be formed up to a location farther apart from the second surface 62. Therefore, even in the case where the amount of the first adhesive 59 used to adhere the head fixing member 13 and the base member 14 tends to vary greatly, it can be made more certain that the first adhesive 59 will reach the adhesive receiving space 67. For example, even when the amount of the first adhesive 59 applied is small so that, in the space between the head fixing member 13 and the base member 14, the first adhesive 59 does not reach the second surface 62 or the third surface 63, the first adhesive 59 is more likely to reach the adhesive receiving space 67. Then, at the time of adhering the protective member 15, the second adhesive 60 fills the adhesive receiving space 67. Therefore, formation of a gap between the head fixing member 13 and the base member 14 can be further inhibited. Incidentally, other configurations are the same as those in the foregoing first exemplary embodiment and will not be described again here. Furthermore, the dimensions of the chamfers illustrated as examples in the foregoing exemplary embodiments can also be set in the same manner as the dimension of the chamfer in this exemplary embodiment.

By the way, although in the foregoing exemplary embodiments, the chamfers are each uniform in shape along a direction parallel to the first surface 61 and parallel to the second surface 62, this is not restrictive. For example, in a head fixing member 13 in a sixth exemplary embodiment illustrated in FIG. 14 and a head fixing member 13 in a seventh exemplary embodiment illustrated in FIG. 15, a chamfer is formed so as to change in shape (size) in a direction parallel to the first surface 61 and the second surface 62.

Figure 14:
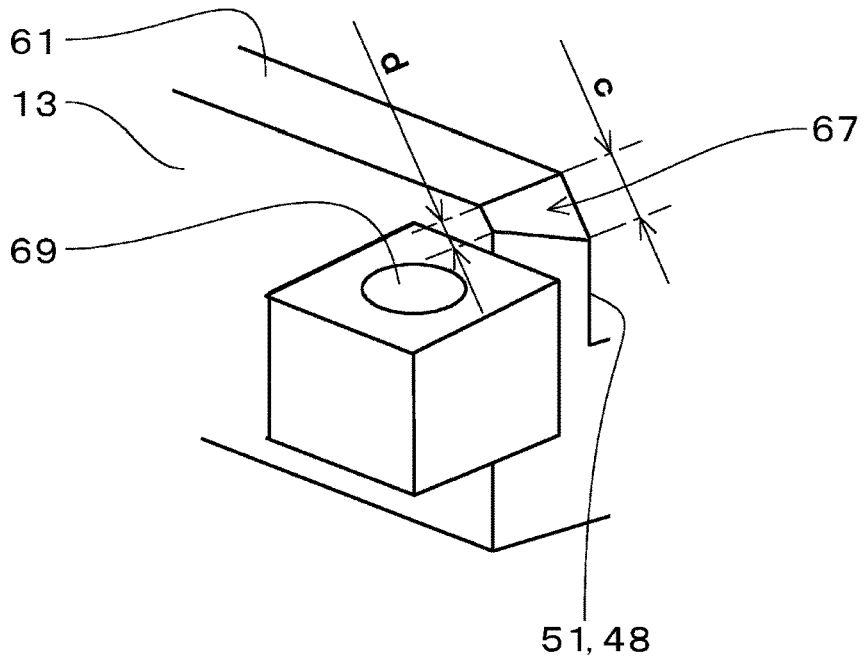
FIG. 14 is an enlarged perspective view of portions of a head fixing member according to a sixth exemplary embodiment.

Concretely, with regard to the chamfer in the sixth exemplary embodiment illustrated in FIG. 14, a dimension c of the chamfer measured between a first surface 61-side end and a second surface 62-side end (i.e., a protective member 15-side end) on the accommodating space 51 side (i.e., the inner side) is larger than a dimension d of the chamfer measured between a first surface 61-side end and a second surface 62-side end (i.e., a protective member 15-side end) on the opposite side of the chamfer to the accommodating space 51 (i.e., the outer side of the chamfer). Furthermore, in this exemplary embodiment, the chamfer is formed so that the dimension between the first surface 61-side end and the second surface 62-side end (i.e., the protective member 15-side end) becomes gradually smaller from the accommodating space 51 side toward the opposite side (the outer side). This configuration can inhibit the first adhesive 59 from squeezing out to the side remote from the accommodating space 51 (i.e., to the outer side) when the head fixing member 13 and the base member 14 are adhered. This also can inhibit the second adhesive 60 from squeezing out to the side remote from the accommodating space 51 (i.e., to the outer side) when the protective member 15 is adhered. As a result, as illustrated in FIG. 14, even in the case where, for example, a screw hole 69 for fixing the head fixing member 13 and the carriage 4 to each other is provided at the outer side of the first partition wall 50, the adhesive (the first adhesive 59 or the second adhesive 60) can be inhibited from depositing in or near the screw hole 69. As a result, an inconvenient situation in which the inserting or fastening of a screw into the screw hole 69 is impeded by the adhesive can be substantially avoided. Therefore, the reliability of the recording head 3 can be increased.

Figure 15:
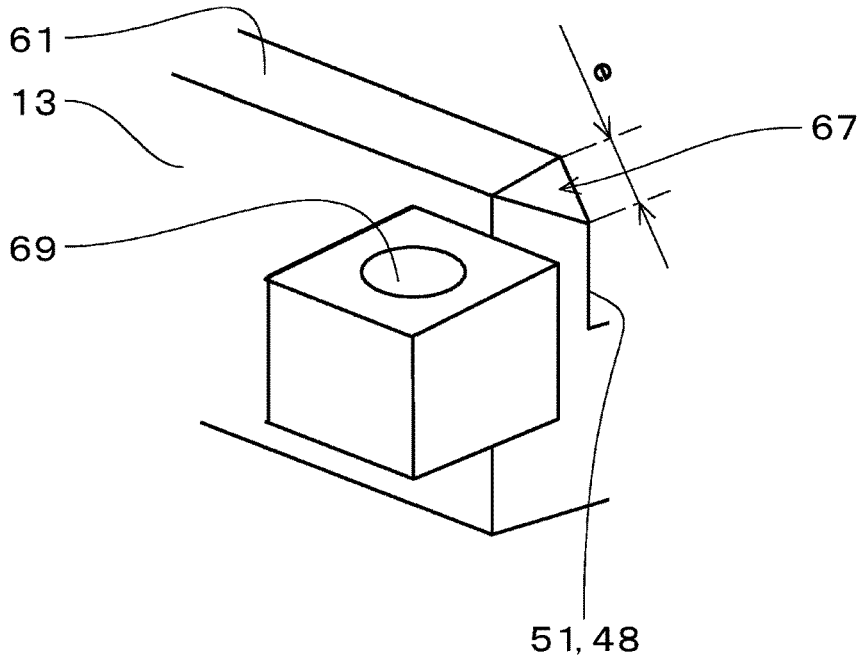
FIG. 15 is an enlarged perspective view of portions of a head fixing member according to a seventh exemplary embodiment.
Figure 16:
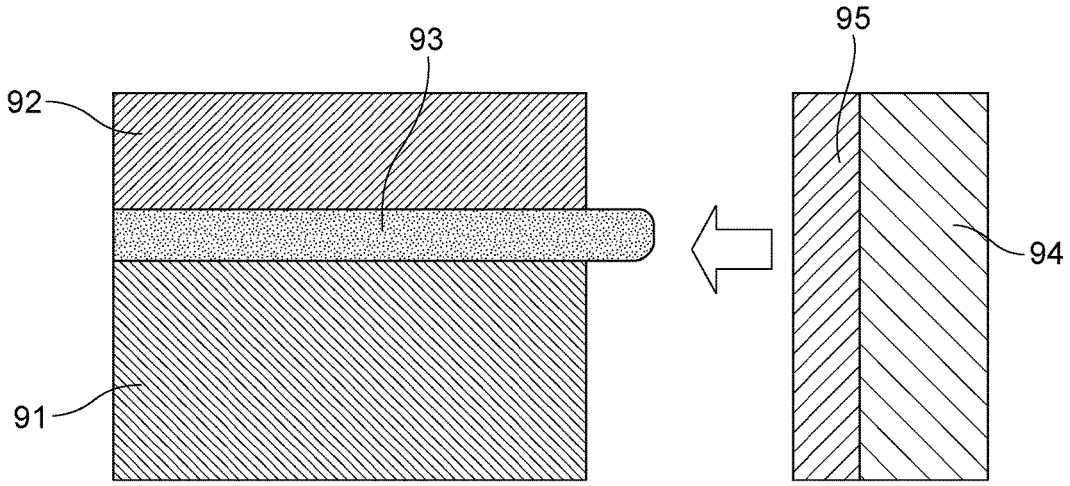
FIG. 16 is an enlarged sectional view of portions of a related-art recording head, illustrating a configuration thereof.
Figure 17:
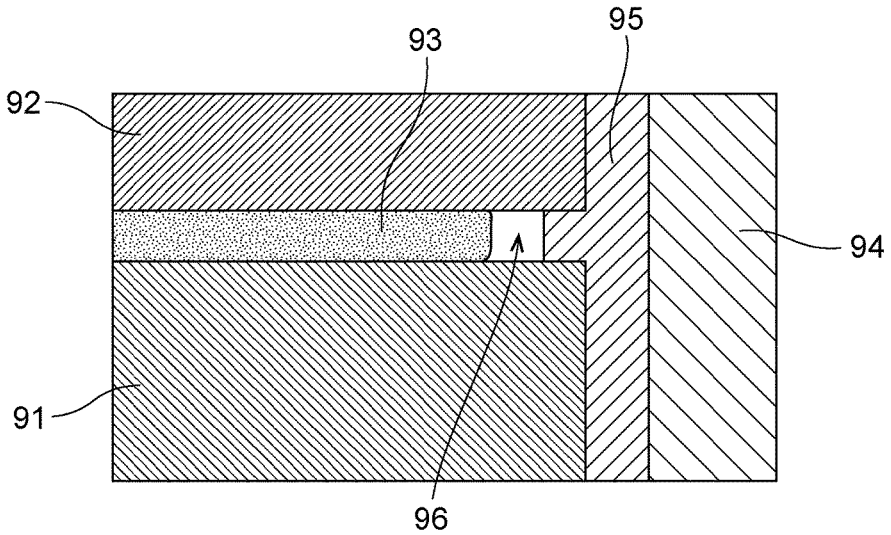
FIG. 17 is an enlarged sectional view illustrating a configuration of the portions of the related-art recording head.

With regard to the chamfer in the seventh exemplary embodiment illustrated in FIG. 15, a dimension of the chamfer measured between a first surface 61-side end and a second surface 62-side end (i.e., a protective member 15-side end) on the opposite side of the chamfer to the accommodating space 51 (i.e., on the outer side of the chamfer) is substantially zero. That is, in this exemplary embodiment, too, a dimension e of the chamfer measured between a first surface 61-side end and a second surface 62-side end (i.e., a protective member 15-side end) on the accommodating space 51 side (i.e., the inner side) of the chamfer is larger than the dimension of the chamfer measured between the first surface 61-side end and the second surface 62-side end (i.e., the protective member 15-side end) on the opposite side of the chamfer to the accommodating space 51 (on the outer side of the chamfer). Furthermore, in this exemplary embodiment, too, the chamfer is formed so that the dimension of the chamfer between the first surface 61-side end and the second surface 62-side end (i.e., the protective member 15-side end) becomes gradually smaller from the accommodating space 51 side to the opposite side (the outer side). This configuration can inhibit the first adhesive 59 from squeezing out to the side remote from the accommodating space 51 (i.e., to the outer side) when the head fixing member 13 and the base member 14 are adhered. This also can inhibit the second adhesive 60 from squeezing out to the side remote from the accommodating space 51 (i.e., to the outer side) when the protective member 15 is adhered. As a result, even in the case where, for example, a screw hole 69 for fixing the head fixing member 13 and the carriage 4 to each other is provided at the outer side of the first partition wall 50, the adhesive (the first adhesive 59 or the second adhesive 60) can be inhibited from depositing in or near the screw hole 69. As a result, an inconvenient situation in which the inserting or fastening of a screw into the screw hole 69 is impeded by the adhesive can be substantially avoided. Therefore, the reliability of the recording head 3 can be increased.

Note that the configurations of the chamfers in the second to fifth exemplary embodiments illustrated in FIGS. 10 to 13 and the configurations of the chamfers in the sixth and seventh exemplary embodiments illustrated in FIGS. 14 and 15 can be combined. Furthermore, the dimension (i.e., the size) of the chamfer between the first surface 61-side end and the second surface 62-side end may be smaller at the accommodating space 51 side than the side remote from the accommodating space 51 according to design. Thus, by changing the size of the chamfer according to design, control of the squeeze-out of the adhesive can be facilitated. That is, by making the chamfer smaller in size on one of the accommodating space 51 side and the side remote from the accommodating space 51 on which it is desired to inhibit the squeezing-out of the adhesive the squeezing-out of the adhesive to that side can be inhibited. As a result, for example, a defective condition in which the adhesive deposits on other component parts or the like can be inhibited and the reliability of the recording head 3 can be increased.

Although in the foregoing exemplary embodiments, the accommodating space 51 is made up of the first accommodating recess portion 48 that houses the first circuit substrate 49 and the second accommodating recess portion 55 that houses the second circuit substrate 56 as an example configuration, this does not limit the invention. For example, a configuration in which neither a second circuit substrate nor a second accommodating recess portion is provided and a first accommodating recess portion is sealed by a base member and a protective member may be adopted. In this case, the protective member may be a flat platy member that does not define a second accommodating recess portion. Furthermore, a first accommodating recess portion may be formed on the base member side. Further, although in the foregoing exemplary embodiments, the adhesive receiving space 67 is formed on either one or both of the head fixing member 13 side and the base member 14 side, this is not restrictive. For example, a configuration in which an adhesive receiving space is formed on a protective member can also be adopted.

Further, although in the foregoing exemplary embodiments, the driving elements that cause pressure changes in the ink in the pressure chambers are so-called flexural vibration type piezoelectric elements as an example, this is not restrictive. For example, so-called longitudinal vibration type piezoelectric elements, heating elements, and various actuators, such as electrostatic actuators that change the capacity of the pressure chambers by using electrostatic force can also be adopted. Furthermore, although in the foregoing exemplary embodiments, an example of the recording head is a so-called serial head that ejects ink while scanning (moving back and forth) in directions (main scanning directions) that intersect the transport direction of recording media (subsidiary scanning direction), this is not restrictive. The invention is also applicable to a printer that includes a so-called line head in which a plurality of recording heads are arranged in the recording medium width direction.

Furthermore, although the foregoing description has been given in conjunction with the ink jet type recording head 3 provided as an example of a liquid ejecting head, the invention is also applicable to other types of liquid ejecting heads that include flow path members. For example, the invention is also applicable to, for example, color material ejecting heads for use in producing color filters of liquid crystal displays and the like, electrode material ejecting heads for use in forming electrodes of organic electroluminescence (EL) displays, field emission displays (FEDs), etc., bioorganic material ejecting heads for use in producing bio-chips (biochemical devices), etc. A color material ejecting head for a display production apparatus ejects solutions of various color materials of red (R), green (G), blue (B), etc. as kinds of liquid. Furthermore, an electrode material ejecting head for an electrode forming apparatus ejects an electrode material in a liquid state as a kind of liquid and a bioorganic material ejecting head for a chip production apparatus ejects a solution of a bioorganic material as a kind of liquid.

The entire disclosure of Japanese Patent Application No. 2017-032041, filed Feb. 23, 2017 is expressly incorporated by reference herein.

What is claimed is:

1. A liquid ejecting head comprising:

a head body provided with nozzles that eject a liquid;

a first member that has a first surface and a second surface which intersects the first surface and that holds the head body at a location apart from the first surface and the second surface;

a second member that has a third surface and that is adhered to the first surface of the first member by a first adhesive so that the third surface is along a planar direction of the second surface of the first member;

a third member that is disposed so as to extend over the second surface and the third surface and that is adhered to the second surface and the third surface by a second adhesive;

a space surrounded by the first member, the second member, the third member, the first adhesive, and the second adhesive; and an adhesive receiving portion that communicates with an intersection portion at which the first adhesive and the second adhesive contact and that accepts inflow of at least one of the first adhesive and the second adhesive.

2. The liquid ejecting head according to claim 1, wherein the adhesive receiving portion is at least partially defined by a chamfer that is formed on one of the first member and the second member and that extends from a first surface side toward a third member side.

3. The liquid ejecting head according to claim 1, wherein the adhesive receiving portion is at least partially defined by a chamfer that is formed on the first member and that extends from a first surface side toward a third member side and a chamfer that is formed on the second member and that extends from the first surface side toward the third member side.

4. The liquid ejecting head according to claim 2, wherein the chamfer has a curved surface.

5. The liquid ejecting head according to claim 2, wherein a dimension of the chamfer measured between a first surface-side end and a third member-side end on a space side of the chamfer is different from a dimension of the chamfer measured between a first surface-side end and a third member-side end on an opposite side of the chamfer to the space.

6. The liquid ejecting head according to claim 1, wherein a first surface-side width of the adhesive receiving portion is larger than a third member-side width of the adhesive receiving portion.

7. The liquid ejecting head according to claim 1, wherein the second adhesive in a liquid state prior to hardening has lower viscosity than the first adhesive in a liquid state prior to hardening.

8. A liquid ejecting apparatus comprising the liquid ejecting head according to claim 1.

9. A liquid ejecting apparatus comprising the liquid ejecting head according to claim 2.

10. A liquid ejecting apparatus comprising the liquid ejecting head according to claim 3.

11. A liquid ejecting apparatus comprising the liquid ejecting head according to claim 4.

12. A liquid ejecting apparatus comprising the liquid ejecting head according to claim 5.

13. A liquid ejecting apparatus comprising the liquid ejecting head according to claim 6.

14. A liquid ejecting apparatus comprising the liquid ejecting head according to claim 7.

15. A production method for a liquid ejecting head that includes a head body provided with nozzles that eject a liquid, a first member that has a first surface and a second surface which intersects the first surface and that holds the head body at a location apart from the first surface and the second surface, a second member that has a third surface and that is adhered to the first surface of the first member by a first adhesive so that the third surface is along a planar direction of the second surface of the first member, a third member that is disposed so as to extend over the second surface and the third surface and that is adhered to the second surface and the third surface by a second adhesive, a space surrounded by the first member, the second member, the third member, the first adhesive, and the second adhesive, and an adhesive receiving portion that communicates with an intersection portion at which the first adhesive and the second adhesive contact and that accepts inflow of at least one of the first adhesive and the second adhesive, the production method comprising:

a first adhering step of adhering the first member and the second member by the first adhesive; and a second adhering step of adhering the first member and the second member to the third member by the second adhesive after the first adhering step.

* * * * *